US006337666B1

(12) United States Patent
Bishop

(10) Patent No.: US 6,337,666 B1
(45) Date of Patent: Jan. 8, 2002

(54) PLANAR SLEEVE DIPOLE ANTENNA

(75) Inventor: Bruce Bishop, Aptos, CA (US)

(73) Assignee: Rangestar Wireless, Inc., Aptos, CA (US)

( * ) Notice: Subject to any disclaimer, the term of this patent is extended or adjusted under 35 U.S.C. 154(b) by 0 days.

(21) Appl. No.: 09/655,178

(22) Filed: Sep. 5, 2000

(51) Int. Cl.[7] ..... H01Q 9/28

(52) U.S. Cl. ..... 343/795; 343/700 MS; 343/702

(58) Field of Search ..... 343/700 MS, 702, 343/793, 795, 906

(56) References Cited

U.S. PATENT DOCUMENTS 5,387,919 A 2/1995 Lam et al. ..... 343/821
5,754,145 A 5/1998 Evans ..... 343/795
5,949,383 A * 9/1999 Hayes et al. ..... 343/795
6,067,052 A 5/2000 Rawles et al. ..... 343/741
6,081,242 A 6/2000 Wingo ..... 353/860
6,084,548 A 7/2000 Hirabe ..... 343/700
6,091,366 A 7/2000 Zhang et al. ..... 343/700

* cited by examiner

*Primary Examiner*—Tan Ho
(74) *Attorney, Agent, or Firm*—Fulbright & Jaworski LLP

(57) ABSTRACT

A printed antenna comprises an elongate first dipole half element provided on one side of a dielectric substrate. The first dipole half element is end-fed via a microstrip transmission line. A second dipole half element is provided on the opposite side of the dielectric substrate. The second dipole includes first and second elongate elements disposed one on each side of the longitudinal axis of the first dipole half element as viewed through the substrate. The first and second elements are a quarter of a wavelength long and are parallel to the first dipole half element. A ground plane on the second side of the substrate is coupled to the first and second elongate elements at a distance from a free end of the first dipole half element corresponding substantially to a quarter wavelength of the frequency of interest.

23 Claims, 9 Drawing Sheets

CHANNEL: S21
ROTATION: ELEVATION

DUT DESCRIPTION: 90 DEG
Tx Pol: VERTICAL

| FREQ (MHz) | TRACE | BEAM PEAK DEG | BEAM PEAK dB1 |
|---|---|---|---|
| 2400.00 | ---------- | -71.67 | 1.29 |
| 2420.00 | ---------- | -76.35 | 1.12 |
| 2440.00 | ---------- | -57.50 | 1.56 |
| 2460.00 | ---------- | -57.50 | 2.02 |
| 2480.00 | ----- ----- | -57.50 | 1.75 |
| 2500.00 | ----- ----- | -57.50 | 1.35 |

PLANAR SLEEVE DIPOLE ANTENNA

FIELD OF THE INVENTION

The present invention is directed to an antenna unit for a wireless communications device, and more particularly to a compact antenna which is fabricated by disposing a conductive pattern on a substrate.

BACKGROUND OF THE INVENTION

A conventional sleeve antenna comprises a radiation element having an electrical length of one quarter wavelength, a sleeve having an electrical length of one quarter wavelength, and a coaxial cable for feeding a radiation element, wherein an outer conductor of the cable is connected to the sleeve, while an inner conductor of the coaxial cable is extended through the sleeve to be connected to the radiation element.

A conventional inverted type coaxial dipole antenna is constructed such that a central conductor of a coaxial cable is connected via a feeding line to a sleeve, wherein the feeding line is extended through a slot which is formed through an outer tube.

A conventional flat antenna comprises a flat substrate, on a first surface of which a microstrip of a thin conductive film is formed, and on a second surface of which a dipole antenna element and a feeding slot are formed.

The conventional sleeve antenna and inverted type coaxial dipole antenna involve complicated fabrication and adjustment because the feeding coaxial cable is connected to the sleeve.

U.S. Pat. No. 5,387,919 discloses a printed circuit antenna comprising an electrically insulating substrate on opposite sides of which are oppositely directed U-shaped, quarter wave, metallic radiators disposed symmetrically about a common longitudinal axis. The bases of the U-shaped radiators overlie each other and are respectively coupled to balanced transmission line conductors to one end of which a coaxial cable is connected, the other end being connected to a balun. By arranging the balun, coaxial cable and the balance conductors along the axis of the radiators, they do not interfere with the radiation pattern from the radiators. The requirement to use a balun limits the usage of the printed antenna because the antenna itself cannot be coupled directly to an input circuit of a receiver and/or output circuit of a transmitter.

U.S. Pat. No. 5,754,145 discloses a printed circuit antenna comprising an end fed elongate first dipole element provided on one side of a dielectric substrate. A second dipole element is provided on the opposite side of the dielectric substrate. The second dipole comprises first and second elongate elements disposed one on each side of the longitudinal axis of the first dipole element as viewed through the substrate. A ground plane on the second side of the substrate is connected to the first and second elements at a distance from a free end of the first dipole element corresponding substantially to a quarter wavelength of the frequency of interest.

SUMMARY OF THE INVENTION

In view of the above-mentioned limitations of the prior art antennas, it is an object of the present invention to provide an antenna for use with a portable wireless communications device.

It is another object of the invention to provide an antenna unit which is lightweight, compact, highly reliable, and efficiently produced.

According to one aspect of the present invention there is provided a printed antenna comprising an end fed elongate first dipole half element provided on one side of a dielectric substrate, a second dipole half element provided on a second side of the dielectric substrate, the second dipole comprising first and second elongate elements disposed one on each side of the longitudinal axis of the first dipole half element as viewed through the substrate and a ground plane coextensive with a feed portion of the first dipole half element, said ground plane being connected to the first and second elements. The first and second elements may extend parallel to the longitudinal axis of the first dipole half element as viewed perpendicular to the plane of the substrate.

In preferred embodiments of the present invention, an antenna which couples to a transmitter/receiver, includes a printed circuit board (PCB) substrate. The antenna unit may be mass produced using printed circuit board (PCB) technology, where a dielectric material is selectively configured with a conductive material. The PCB antenna unit can be encapsulated in plastic or other material to create a solid, robust package which is durable and resistant to damage and deterioration.

The antenna unit can be used as part of a wireless voice or data link, or as part of an RF modem. The antenna unit is particularly suitable for use in compact, wireless communication devices such as portable computers, PDA's, palm sized computers or information devices, or as an RF modem for desktop and mainframe computer systems.

Additionally, the antenna unit can be configured to be connected to the device through PCMCIA or Universal Serial Bus (USB) or other types of plug-in ports used in computers and PDA type devices. The antenna can be implemented to transmit and receive on desired frequencies of the device users, including analog or digital U.S. or European cell phone bands, PCS cell phone bands, 2.4 GHZ Bluetooth bands, or other frequency bands as would be obvious to one skilled in the art.

An antenna unit according to the present invention features broad VSWR and gain bandwidth greater than 15%. The invention is an omnidirectional antenna, having efficiency of 90% or greater. The invention can be encapsulated in plastic to produce a mechanically rugged device that is not easily damaged as with common whip dipole antennas.

Yet another aspect of the present invention is an antenna assembly having a selectively movable portion for adjusting the spatial orientation of the antenna, and hence, the polarization characteristics of the antenna. Such a selectively movable portion may include a hinged element having an interiorly disposed antenna displaying vertical, horizontal, or combined polarization characteristics as the hinged movable portion is biased into different positions.

The above and other objects and advantageous features of the present invention will be made apparent from the following description with reference to the accompanying drawings, in which like reference characters designate the same or similar parts throughout the drawings.

BRIEF DESCRIPTION OF THE DRAWINGS

Preferred embodiments of the invention will be described in detail hereinafter with reference to the accompanying drawings wherein.

DETAILED DESCRIPTION OF PREFERRED EMBODIMENTS OF THE PRESENT INVENTION

Figure 1:
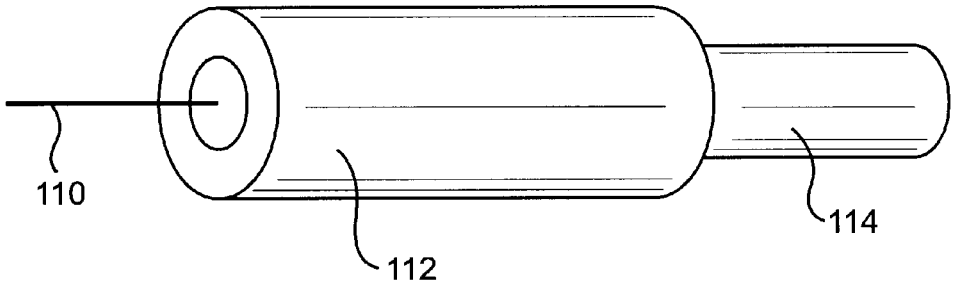
FIG. 1 PRIOR ART
FIG. 1 is a perspective view of a conventional sleeve antenna.

Prior to explaining an antenna in a preferred embodiment according to the present invention, the aforementioned conventional antennas will be explained in more detail. FIG. 1 illustrates a conventional sleeve antenna. Numeral 110 designates a radiating element having an electrical length of one quarter wavelength, numeral 112 a sleeve (a cylindrical tube) having an electrical length of one quarter wavelength, and numeral 114 a feeding coaxial cable. The outer conductor of the coaxial cable 114 is connected to the sleeve 112, while a central conductor of the coaxial cable 114 is connected to the radiating element 110. This sleeve antenna has operating performance equal to a dipole antenna comprising the radiation element 110 and the sleeve 112, good efficiency, good directivity, and stable impedance.

Figure 2:
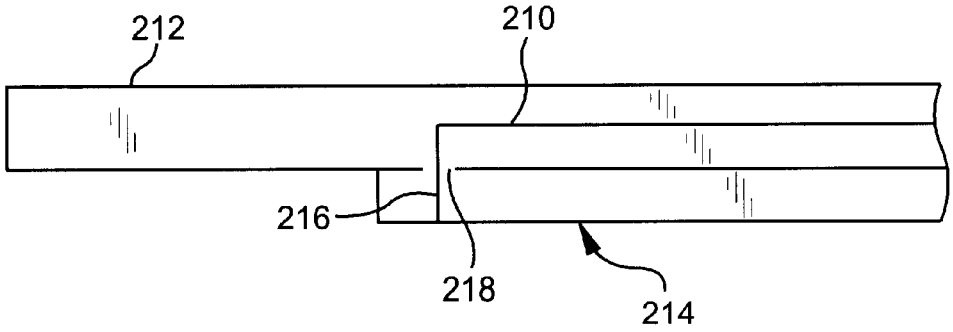
FIG. 2 PRIOR ART
FIG. 2 is a cross sectional view of a conventional inverted type coaxial dipole antenna.

FIG. 2 illustrates a cross-sectional view of a conventional inverted type coaxial dipole antenna where a central conductor 210 and an outer tube 212 are replaced with each other. The central conductor 210 is connected to the sleeve 214 via a feeding line 216 passing through a slot 218 of the outer tube 212. This inverted type coaxial dipole antenna has operation performance equivalent to the above sleeve antenna, good efficiency, good directivity, and stable impedance. Further, a plurality of this type of antennas may be arranged to form an array antenna.

Figure 3:
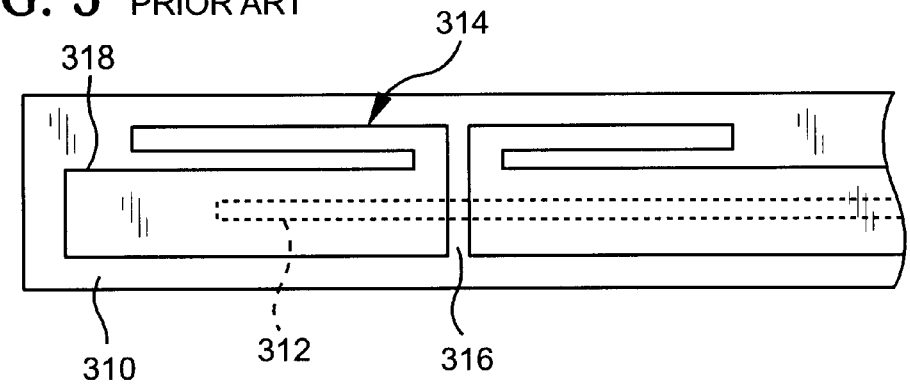
FIG. 3 PRIOR ART
FIG. 3 is a plan view of a conventional flat antenna.

FIG. 3 illustrates a conventional flat antenna comprising a conductor provided on a substrate. In the drawing, numeral 310 designates a dielectric substrate, numeral 312 a microstrip line of a thin-film conductor, numeral 314 a dipole antenna element of a conductor provided on the side of the substrate 310 opposite to the micro-strip line 312, numeral 316 a feeding slot, and numeral 318 a notch having an electrical length of one quarter wavelength. This antenna has operation performance equivalent to the above sleeve antenna, good efficiency, good directivity, and stable impedance.

Next, an antenna in a preferred embodiment according to the present invention will be explained.

Figure 4:
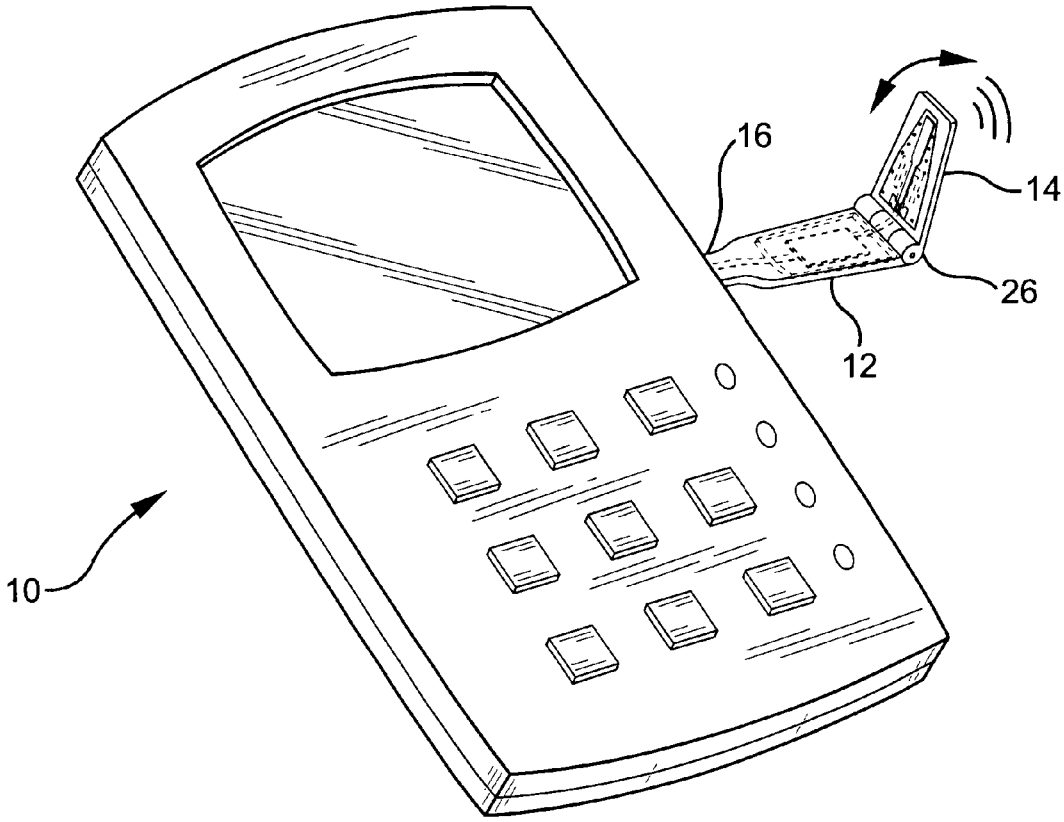
FIG. 4 is perspective view of a wireless communications device and an antenna unit according to the present invention.
Figure 5:
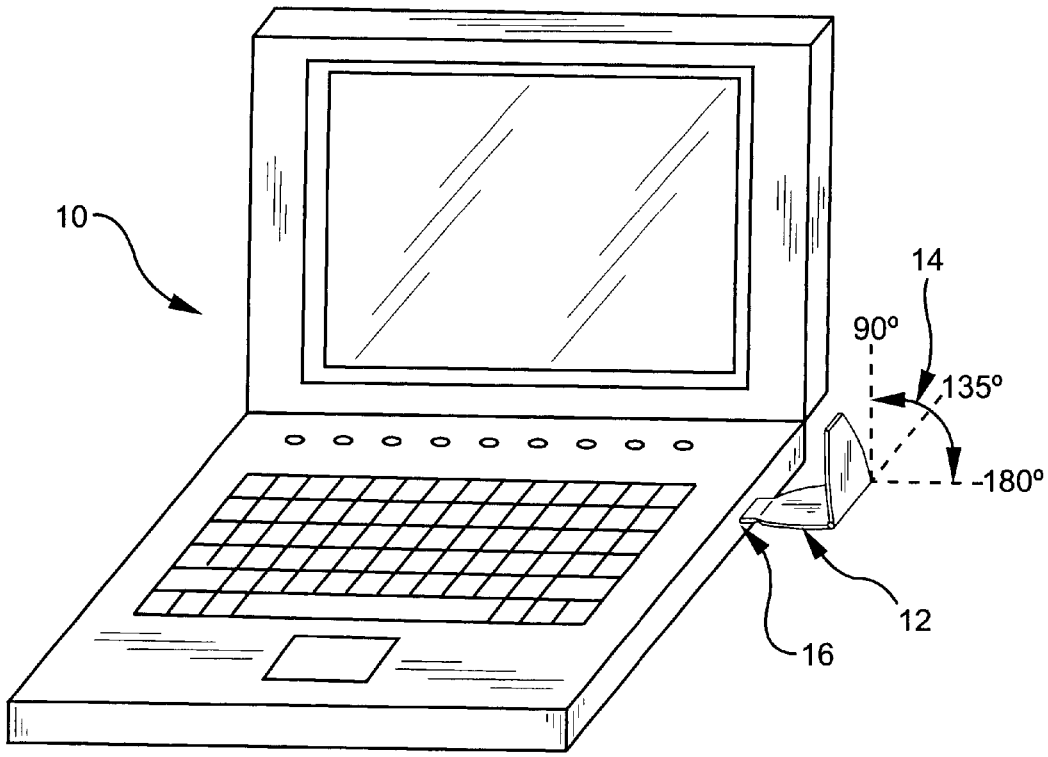
FIG. 5 is a perspective view of another wireless communications device an antenna unit according to the present invention.

FIGS. 4 and 5 illustrate a selectively attachable antenna assembly 12 having disposed therewithin an antenna unit or device 14 according to the present invention. FIG. 4 illustrates a wireless communications device 10, such as a cellular telephone or PDA device. FIG. 5 illustrates a portable computer. The antenna assembly 12 may be coupled directly to the wireless communications device 10, as shown in FIGS. 4 and 5, or may be remotely disposed, such as wall-mounted (not shown), and coupled to the device 10 via a signal cable, etc. The antenna assembly 12 can be used as part of a wireless voice or data link, or as part of an RF modem. The antenna assembly 12 can be coupled to the wireless device 10 through its PCMCIA or Universal Serial Bus (USB) 16 or other plug-in port. In preferred embodiments, the antenna assembly 12 can be implemented to transmit and receive on desired frequencies of the device users, including analog or digital U.S. or European cell phone bands, PCS cell phone bands, 2.4 GHZ Bluetooth bands, or other frequency bands as would be obvious to one skilled in the art.

Figure 6:
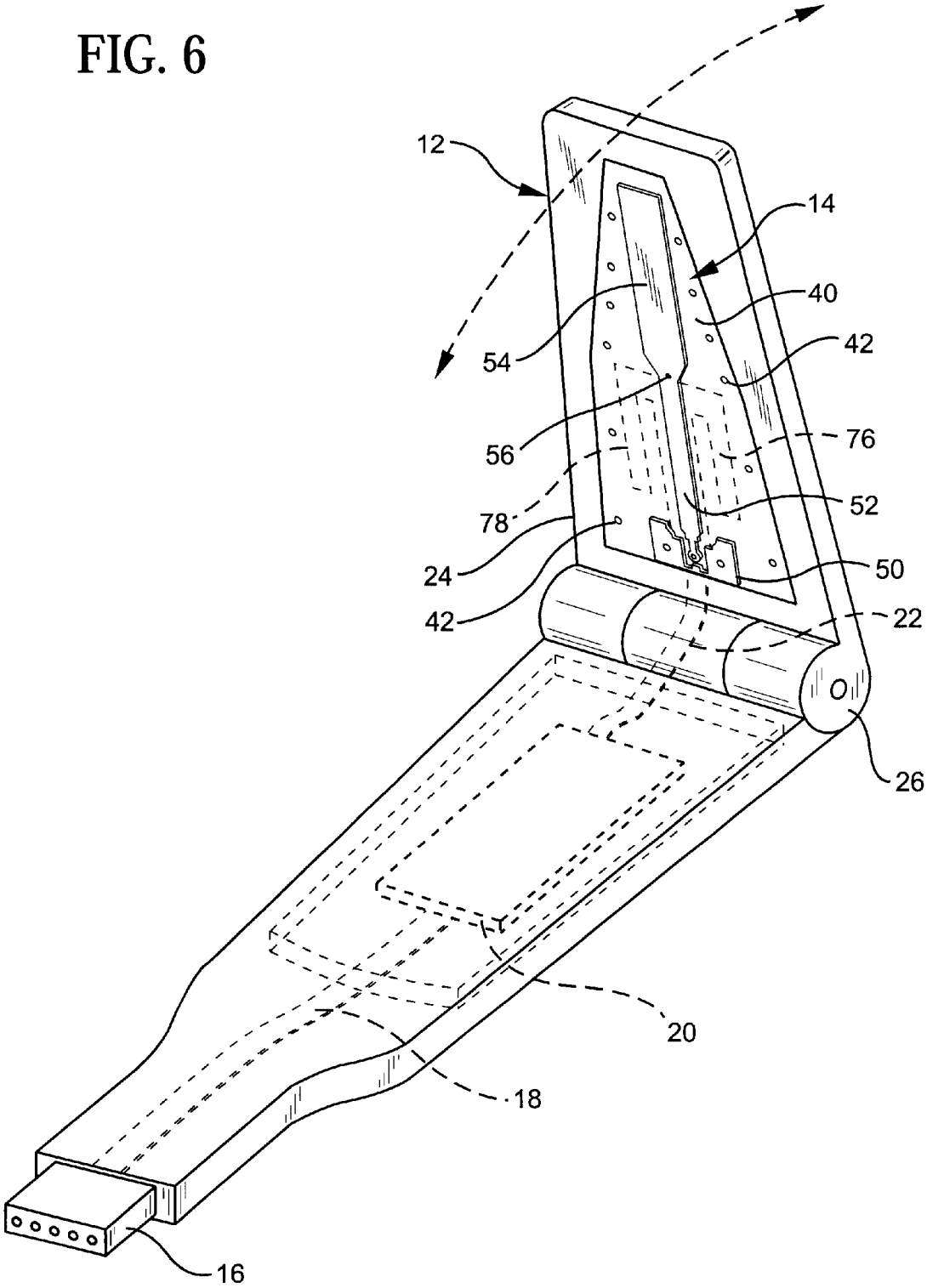
FIG. 6 a detailed perspective view of the antenna unit of FIG. 4.

Referring particularly to FIG. 6, the antenna device 14 may be disposed within a portion of the selectively attachable antenna assembly 12 designed to be coupled to a plug-in port 16 of the wireless communications device 10. The antenna assembly 12 may include a digital signal line 18, an RF modem board 20 coupled to the digital signal line 18, and a coax signal line 22 for coupling to the antenna 14. The antenna assembly 12 of FIGS. 4–6, includes a selectively movable portion 24 within which the antenna device 14 is disposed. The selectively movable portion 24 is coupled to the remaining portion of the antenna assembly 12 via a hinge apparatus 26, though alternative coupling approaches would also be practicable. The hinged movable portion 24 may be biased by the user to provide a particular spatial orientation of the antenna device 14. For example, a preferred orientation of 90° (vertical) is shown in FIGS. 4 and 5. Additional polarizations may be accommodated by adjusting the movable portion 24 to 180° for vertical polarization or to 135° for equal horizontal and vertical antenna polarization characteristics.

The printed antenna 14 includes a substrate 40 of, for example Duroid or glass fiber, or known dielectric printed circuit board material. The substrate element 40 may be a dielectric PC board having a thickness between 0.005" to 0.125" thick. A flexible PCB substrate may also be practicable. Apertures 42 are included in the substrate 40 to facilitate plastic encapsulation of the antenna 14. The details of such encapsulation processes would be appreciated by those skilled in the relevant arts.

Figure 7:
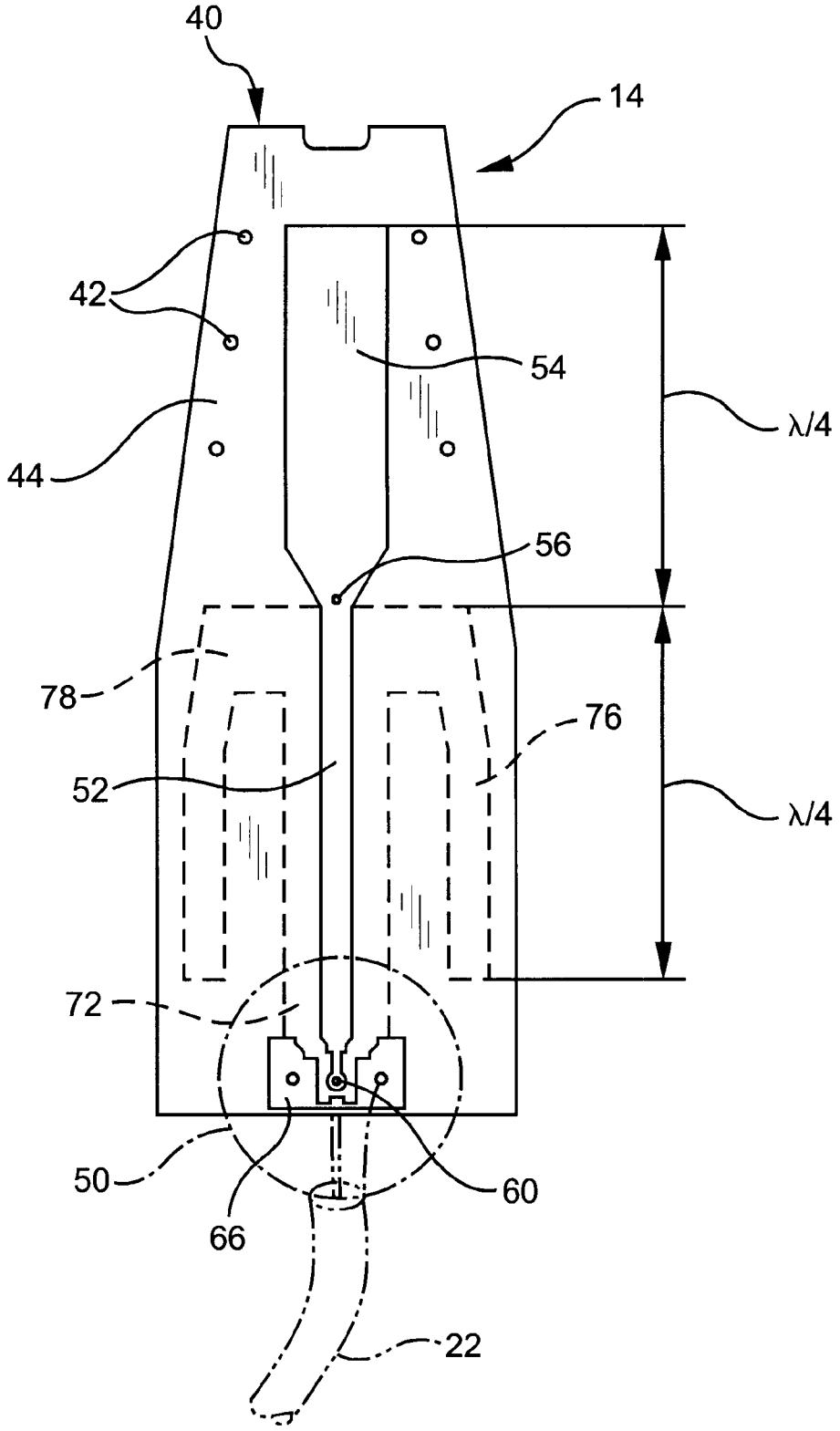
FIG. 7 is a top plan view of a portion of the antenna unit of FIG. 4.
Figure 9:
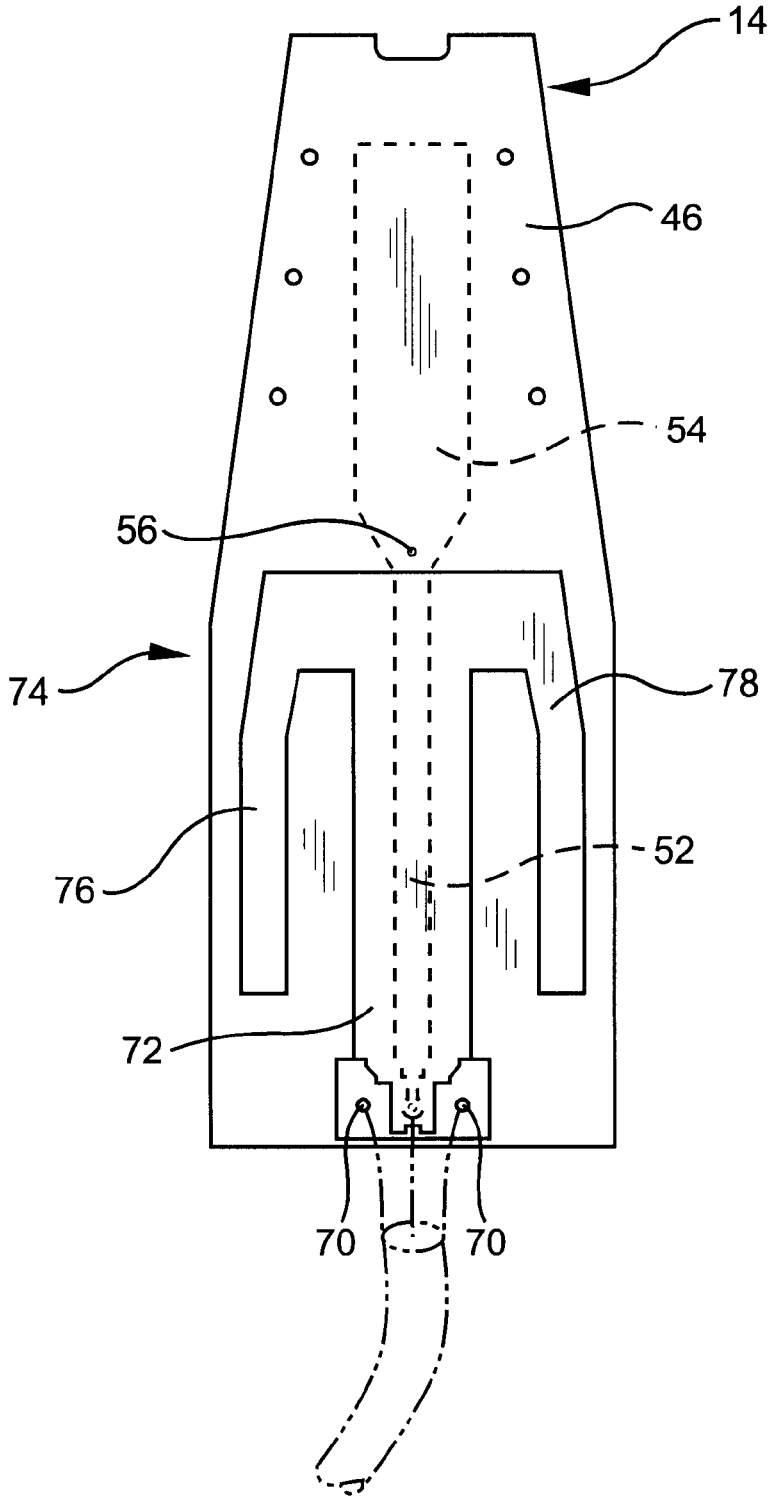
FIG. 9 is a bottom plan view of a portion of the antenna unit of FIG. 4.

Referring particularly to FIGS. 6, 7, and 9, the substrate element 40 includes a first major surface 44 and an opposed second major surface 46. Disposed upon the first major surface 44 of the substrate 40 are: an RF coupling structure 50 for coupling the antenna 14 to the telecommunications device 10 (via digital signal line 18, RF modem 20, and coax signal line 22); a microstrip transmission line 52, and an end-fed quarter wavelength dipole half element 54. A feed point 56 is defined proximate the junction between the microstrip transmission line 52 and the radiating half element 54. In use it is intended that the dipole half 54 be arranged vertically such that the effective part of the dipole 54 is the upper section having an electrical length corresponding substantially to a quarter wavelength of the frequency (or center frequency) of interest.

Figure 8:
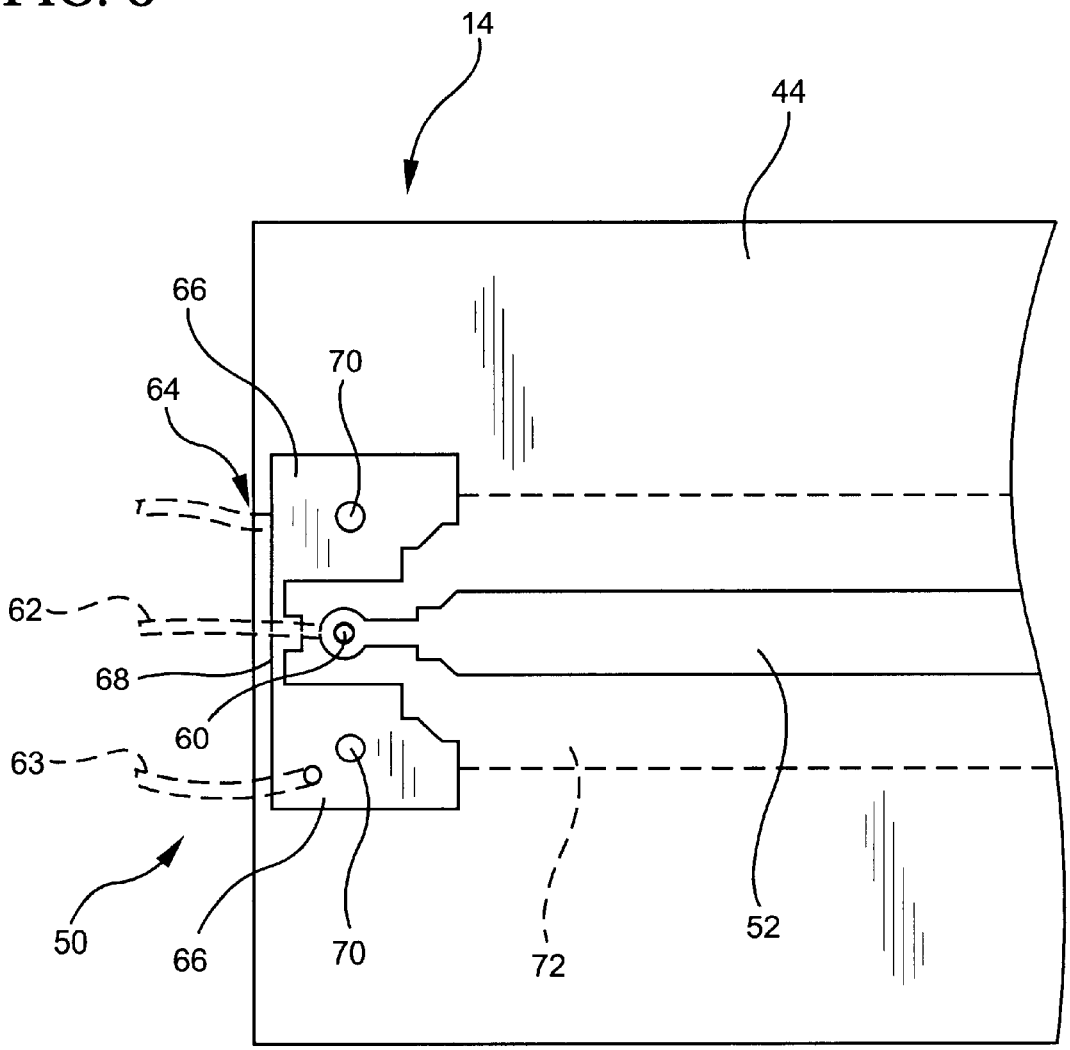
FIG. 8 is a top plan view of a detailed portion of the antenna unit of FIG. 7.

Referring now to FIG. 8, a detailed illustration of the RF coupling structure 50 is disclosed. RF coupling structure 50 includes a signal coupling point 60 at the free end of the microstrip transmission line 52, to which the center conductor 62 of the coax signal line 22 is coupled. RF coupling structure 50 further includes a shield coupling structure 64, including opposed shield conductor pad portions 66 disposed on either side of the signal coupling point 60 and connected via an intermediate conductor portion 68. The shield conductor 63 of the coax signal line 22 is directly coupled to one or both of the shield conductor pad portions 66. Each shield pad portion 66 includes a plated through-hole 70 for coupling to the opposite major surface 46 of the substrate 40 as further described herein.

Referring particularly to FIG. 9, disposed upon the second major surface 46 is a ground plane conductor 72 and a second half dipole 74 comprising first and second elements 76,78 which are connected to the ground plane 72 at a distance corresponding to substantially a quarter wavelength from the free end of the first dipole half element 54 and extending away therefrom. The ground plane 72 is coupled proximate one end to the shield conductor 63 of the coax signal line 22 via the plated through-holes 70 in the substrate 40 at the shield conductor portion 64 of the RF coupling structure 50.

Each of the first and second elements 76,78 has a length corresponding to a quarter wavelength of the frequency (or center frequency) of interest. The first and second elements 76,78 are parallel to the longitudinal axis of the first dipole half element 54. From an RF point of view the first dipole half element 54 and the first and second elements 76,78 form a half wave antenna with the electrical junction between the two half dipoles 54,74 being at a low impedance, typically 50 ohms. The central feed point 56 is proximate the point of convergence of the first and second elements 76,78. The lateral spacing of the lower radiating arms 76,78 from the central microstrip transmission line ground plane 72 is optimized to reduce currents on the connecting feed cable 22.

Each conductor element 52, 54, 72, 76, 78 on the substrate 40 may be produced by printed board fabrication processes. Alternatively, the conductor elements 52, 54, 72, 76, 78 may be prepared by applying a conductive foil, for example, a copper foil. In the antenna 14 shown in FIGS. 4–8, the conductor elements 52, 54, 72, 76, 78 are provided on a planar substrate, realizing a thin, lightweight antenna 14. Further, since the antenna 14 may be prepared by printed board fabrication processes, the dimensional accuracy is very good. Since the substrate 40 and the conductors 52, 54, 72, 76, 78 are integral with each other, there is no need for extensive assembly.

Those skilled in the relevant arts may appreciate that the conductor elements 52, 54, 72, 76, 78 could be implemented as meandered conductor lines to reduce the overall antenna 14 package length.

The operation of the antenna 14 will be explained. A feed signal applied to the microstrip transmission line 52 via the RF coupling structure 50 passes to the first dipole half element 54. This permits a radio wave to be radiated from the radiation element 54. Impedance matching between the first dipole half element 54 and the microstrip transmission 52 may be performed by regulating the position, in the longitudinal direction of the dipole radiating element 54, at which the feed point 56 is coupled to the radiating element 54.

Figure 10:
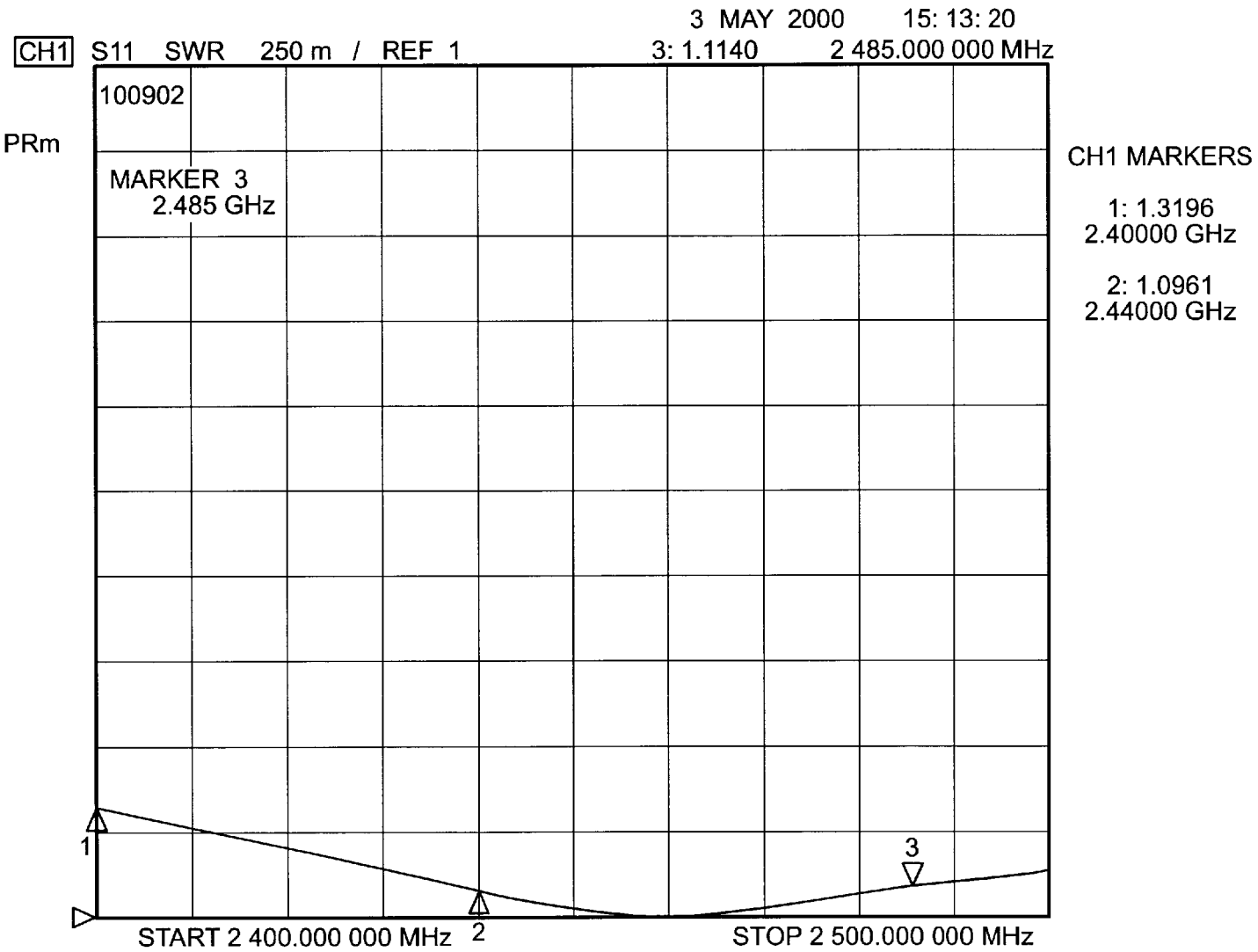
FIG. 10 is a graph illustrating gain characteristic of the antenna unit of FIG. 4.
Figure 11:
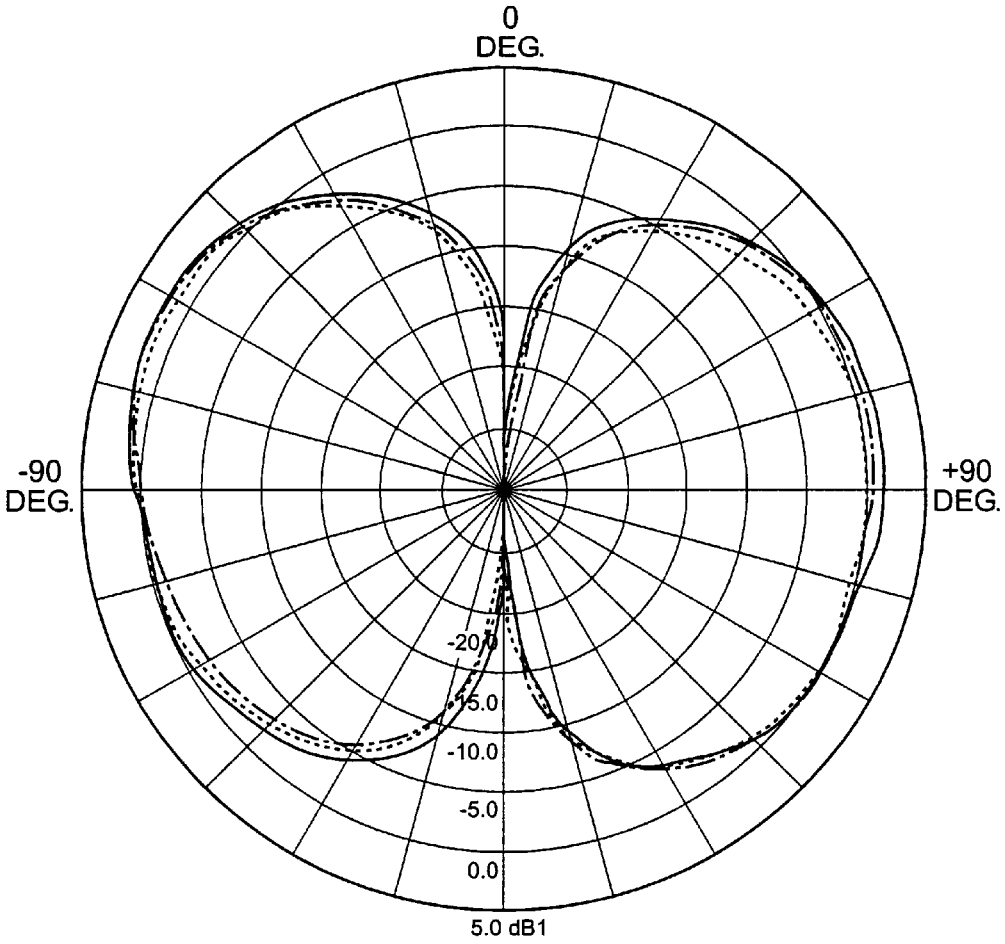
FIG. 11 is a graph showing directional characteristic of the antenna unit of FIG. 4.

FIG. 10 is a plot of an VSWR measurement of the present antenna 14, taken at the output/input coupling structure using a network analyzer. Markers 1, 2 and 3 on the plot correspond to measurement frequencies of 2.400, 2.440, and 2.485 GHz, yielding corresponding to VSWR measurements of 1.3195, 1.0961, and 1.1140, respectively. The measurements confirm an effective operating bandwidth of 85 MHz for the disclosed antenna 14. FIG. 11 is an elevational pattern of the present antenna 14, taken with an automated antenna measurement system. FIG. 11 reveals that the antenna configuration yields a gain greater than 0 dBi over 75° in elevation (from +45° degrees to −30°). An azimuth pattern yields an omnidirectional pattern at horizon with a variation of less than 1 dB.

While the foregoing description represents preferred embodiments of the invention, it will be obvious to those skilled in the art that various changes and modifications may be made, without departing from the spirit and scope of the invention as defined by the following claims.

What is claimed is:

1. An antenna comprising:

a dielectric substrate element having a pair of opposed major surfaces;

an RF signal coupling structure disposed upon the substrate element;

a microstrip transmission line disposed upon one of the major surfaces of the substrate element and coupled to the RF signal coupling structure, said microstrip transmission line having a predetermined width dimension;

an end fed elongate first dipole half element disposed upon one of the major surfaces of the substrate element, said first dipole half element having a predetermined width dimension which is substantially larger than the predetermined width dimension of the microstrip transmission line, said first dipole half element being coupled to the microstrip transmission line;

a ground plane disposed upon the substrate element on the major surface opposite the microstrip transmission line, said ground plane having a predetermined width dimension which is substantially larger than the microstrip transmission line width dimension; and a second dipole half element disposed upon substrate element on the major surface opposite the first dipole half element, the second dipole half element including first and second elongate elements disposed one on each side of a longitudinal axis of the first dipole half element as viewed through the substrate, said first and second element being coupled to the ground plane.

2. An antenna according to claim 1, wherein the ground plane is connected to the first and second elements at a distance corresponding substantially to a quarter wavelength of the frequency of interest from a free end of the first dipole half element, and wherein the lengths of the first and second elements correspond substantially to said distance.

3. An antenna according to claim 1, wherein the first and second elements are parallel relative to each other.

4. An antenna according to claim 1, wherein the microstrip transmission line and the first dipole half element are disposed on the same major surface of the dielectric substrate.

5. An antenna according to claim 1, wherein the ground plane and the second dipole have element are disposed on the same major surface of the dielectric substrate.

6. An antenna according to claim 1, wherein the RF coupling structure is disposed upon the same side of the dielectric substrate element at the first dipole half element.

7. An antenna according to claim 6, wherein the RF coupling structure includes a pair of shield conductor pad portions and an intermediate connecting element.

8. An antenna according to claim 7, wherein the RF coupling structure includes one or more plated through holes for coupling the shield conductor pad portions to the ground plane.

9. An antenna comprising:

a dielectric substrate element having a pair of opposed major surfaces;

a microstrip transmission line disposed upon one of the major surfaces of the substrate element, said microstrip transmission line having a width of a predetermined dimension;

an end fed elongate first dipole half element disposed upon one of the major surfaces of the substrate element, said first dipole half element having a predetermined width dimension which is substantially larger than the predetermined width dimension of the microstrip transmission line, said first dipole half element being coupled to the microstrip transmission line;

a ground plane disposed upon the substrate element on the major surface opposite the microstrip transmission line, said ground plane having a predetermined width dimension which is substantially larger than the width of the microstrip transmission line; and a second dipole half element disposed upon substrate element on the major surface opposite the first dipole half element, the second dipole half element including first and second elongate elements disposed one on each side of the ground plane, said first and second element being coupled to the ground plane.

10. An antenna according to claim 9, further comprising:

an RF coupling structure operatively coupled to both the microstrip transmission line and the ground plane.

11. An antenna according to claim 10, wherein the RF coupling structure is disposed upon the same side of the dielectric substrate element at the first dipole half element.

12. An antenna according to claim 11, wherein the RF coupling structure includes a pair of shield conductor pad portions and an intermediate connecting element.

13. An antenna according to claim 12, wherein the RF coupling structure includes one or more plated through holes for coupling the shield conductor pad portions to the ground plane.

14. An antenna according to claim 9, wherein the microstrip transmission line and the first dipole half element are on the same major surface of the dielectric substrate.

15. A method of manufacturing an antenna assembly for a wireless communications device, said method comprising the steps of:

providing a dielectric substrate element having a pair of opposed major surfaces;

disposing a microstrip transmission line upon one of the major surfaces of the substrate element, said microstrip transmission line having a predetermined width dimension;

disposing an end-fed elongate first dipole half element upon one of the major surfaces of the substrate element, said first dipole half element having a predetermined width dimension which is substantially larger than the predetermined width dimension of the microstrip transmission line, said first dipole half element being coupled to the microstrip transmission line;

disposing a ground plane upon the substrate element on the major surface opposite the microstrip transmission line, said ground plane having a predetermined width dimension which is substantially larger than the width dimension of the microstrip transmission line; and disposing a second dipole half element disposed upon substrate element on the major surface opposite the first dipole half element, the second dipole half element including first and second elongate elements one on each side of the ground plane, said first and second element being coupled to the ground plane.

16. The method of manufacturing an antenna according to claim 15, wherein the step of disposing the end-fed elongate first dipole half element includes a printed circuit board fabrication etching process.

17. The method of manufacturing an antenna according to claim 15, wherein the step of disposing the end-fed elongate first dipole half element includes applying a conductive layer to the dielectric substrate element.

18. An antenna assembly for a wireless communications device, comprising:

a frame including a selectively movable portion;

a dielectric substrate element disposed upon the movable portion and having a pair of opposed major surfaces;

an RF signal coupling structure disposed upon the substrate element;

a microstrip transmission line disposed upon one of the major surfaces of the substrate element and coupled to the RF signal coupling structure;

an end fed elongate first dipole half element disposed upon one of the major surfaces of the substrate element, said first dipole half element being coupled to the microstrip transmission line;

a ground plane disposed upon the substrate element on the major surface opposite the microstrip transmission line; and a second dipole half element disposed upon substrate element on the major surface opposite the first dipole half element, the second dipole half element including first and second elongate elements disposed one on each side of a longitudinal axis of the first dipole half element as viewed through the substrate, said first and second element being coupled to the ground plane.

19. An antenna assembly of claim 18, wherein the frame is adapted to be selectively attachable to wireless communications device.

20. An antenna assembly of claim 18, wherein the selectively movable portion of the frame may be placed in a substantially vertical or horizontal orientation.

21. An antenna assembly of claim 18, wherein the selectively movable portion of the frame is hingedly coupled to the frame.

22. An assembly comprising:

a wireless communications device having a communications port;

an antenna being selectively coupled to the wireless communications device at the communications port, said antenna including a dielectric substrate element disposed upon the movable portion and having a pair of opposed major surfaces; an RF signal coupling structure disposed upon the substrate element; a microstrip transmission line disposed upon one of the major surfaces of the substrate element and coupled to the RF signal coupling structure; an end fed elongate first dipole half element disposed upon one of the major surfaces of the substrate element, said first dipole half element being coupled to the microstrip transmission line; a ground plane disposed upon the substrate element on the major surface opposite the microstrip transmission line; and a second dipole half element disposed upon substrate element on the major surface opposite the first dipole half element, the second dipole half element including first and second elongate elements disposed one on each side of a longitudinal axis of the first dipole half element as viewed through the substrate, said first and second element being coupled to the ground plane.

23. An assembly of claim 22, wherein the antenna includes a selectively movable portion for adjusting a polarization characteristic of the antenna.

* * * * *